US011890509B2

(12) United States Patent
Park

(10) Patent No.: US 11,890,509 B2
(45) Date of Patent: Feb. 6, 2024

(54) SWIMMING ASSISTANCE MECHANISM

(71) Applicant: Leen Chul Park, Busan (KR)

(72) Inventor: Leen Chul Park, Busan (KR)

( * ) Notice: Subject to any disclaimer, the term of this patent is extended or adjusted under 35 U.S.C. 154(b) by 444 days.

(21) Appl. No.: 17/271,729

(22) PCT Filed: Aug. 30, 2019

(86) PCT No.: PCT/KR2019/011109
§ 371 (c)(1),
(2) Date: Feb. 26, 2021

(87) PCT Pub. No.: WO2020/046030
PCT Pub. Date: Mar. 5, 2020

(65) Prior Publication Data

US 2021/0316188 A1 Oct. 14, 2021

(30) Foreign Application Priority Data

Aug. 30, 2018 (KR) ..... 10-2018-0102705

(51) Int. Cl.
*A63B 31/12* (2006.01)

(52) U.S. Cl.
CPC ..... *A63B 31/12* (2013.01); *A63B 2225/60* (2013.01); *A63B 2244/20* (2013.01)

(58) Field of Classification Search
CPC ..... A63B 31/12; A63B 31/14; A63B 31/10; A63B 2225/60; A63B 2209/02; A63B 2209/10; A63B 2209/00; A63B 2244/20
USPC ..... 441/55, 59
See application file for complete search history.

(56) References Cited

U.S. PATENT DOCUMENTS 4,521,011 A * 6/1985 Solloway ..... A63B 31/14 441/59
4,756,699 A * 7/1988 Brom ..... A63B 31/14 441/59
5,055,075 A * 10/1991 Waller, Jr. ..... A63B 31/12 441/59

FOREIGN PATENT DOCUMENTS

JP 2015-181793 A 10/2015
KR 20-1995-0013395 U 6/1995
KR 10-2001-0007880 A 2/2001
KR 20-0305593 Y1 2/2003
KR 10-2005-0114809 A 12/2005
KR 10-2007-0051158 A 5/2007

* cited by examiner

*Primary Examiner* — Daniel V Venne
(74) *Attorney, Agent, or Firm* — Revolution IP, PLLC

(57) ABSTRACT

The present invention relates to a swimming assistance mechanism and, more specifically, to a swimming assistance mechanism that is attached to the arms and increases a propulsion effect by increasing resistance against water via an action like that of the fins of a fish when paddling with the arms for propulsion, so as to assist in enabling easier swimming. The swimming assistance mechanism of the present invention is characterized by comprising: a main body fixed between the palm and the elbow; and a fin foldably installed on the outer surface of the main body.

7 Claims, 6 Drawing Sheets

SWIMMING ASSISTANCE MECHANISM

TECHNICAL FIELD

The present invention relates to a swimming assistance mechanism, and more particularly, to a swimming assistance mechanism that is attached to the arms and increases a propulsion effect by increasing resistance against water via an action like that of the fins of a fish when paddling with the arms for propulsion, so as to assist in enabling easier swimming.

BACKGROUND ART

In general, during swimming, a propulsion is obtained by repeating a motion of splitting a water current with palms by moving both arms rearward in a circular shape from a head. However, human hands have no webs between toes like ducks, so unskilled people cannot swim smoothly.

Accordingly, various swimming assistance mechanisms in the form of gloves with webs for expanding the area of the palm have been developed to enable a swimmer to swim more easily. Recently, improved technologies have been disclosed to be worn on the arm to increase the propulsion to water. Korean Patent Publication No. 10-2007-0051158 discloses a technology that a fin is integrally formed on a fixing ring to an arm is fitted so that the fin is steered by a handler to control propulsion and direction.

However, the structure is not practical because the swimming is performed using the fin positioned rearward from an elbow through a motion of bending and unfolding the arm, so it is generally not easy to use during swimming with stable breaststroke or backstroke among types of swimming, and, it is difficult to swim while steering with the handler in the swimming process.

In addition, Korean Utility Model Registration No. 20-0305593 has a structure that a wing folded is attached to a body installed at the bottom of a fixing band so as to divide a water current and propel the water current by the operation of the wing. Although the swimming is assisted by the motion of the wing, the body is separately installed under the fixing band worn on the arm and the wing is attached to the body, so it is reluctant to wear due to the large size, uncomfortable for activities, heavy, and accordingly, very inconvenient during the play in the water.

DISCLOSURE

Technical Problem

The present invention is provided to solve the above conventional problems. An object of the present invention is to provide a swimming assistance mechanism in which a fin folded and unfold like an umbrella is installed on a main body fitting from the palm to the arm, so that the fin is deployed when cleaving the current and folded when not cleaving the current, thereby obtaining a continuous propulsion.

Technical Solution

In order to achieve the above-mentioned object, the present invention provides a swimming assistance mechanism including a main body fixed between the palm and the elbow; and a fin foldably installed on the outer surface of the main body, wherein the main body is formed of a soft synthetic resin material having a strength, and is formed at one side thereof with an opening having a length fitted between a palm and an elbow and opened at intervals in a longitudinal direction, in which a groove for exposing a base of a thumb is formed at a front palm contact part to which a hand is inserted, and the fin is formed of a durable synthetic fiber, has a U-shape spread outward from the main body except an upper portion on an outer surface of the main body arranged with the arm thereon, and is fixed to a plurality of transverse and longitudinal ribs having hinges on an outer periphery of the main body, and wherein outer ends of the ribs are connected to a plurality of wires wound on a wire winding device at a center of the main body so as to be folded on the outer surface of the main body by elastic force due to wire-winding, and unfold while the wires are pulled and released by a water current overcoming the elastic force.

Fastening bands for fastening the arm using a Velcro fastener or clip may be attached to both end portions and a middle portion of the opening so that the body is fixed and prevented from moving when worn on the arm.

The main body may have a shape coming into close contact with the hand and the arm when the arm is inserted through the opening.

The wire winding device may be mounted therein with a bobbin elastically rotated inside a casing and a leaf spring wound to have a coil shape at an inner side of the bobbin, the wires may be sequentially fixed to an outer surface of the bobbin so as to be pulled while the leaf spring is wound when the wires are pulled and so as to be wound around the bobbin due to returning elastic force of the leaf spring when pulling force is removed, and the number of the wire winding device may be at least one, so that the fin unfold by the water current is folded by winding the wires.

The ribs may be formed of synthetic resin or aluminum to have a curved shape so as to come into close contact with a curved surface of the main body when folded about the hinges, in which the outer end forms a clearance when folded to be spaced apart from the main body to allow water to enter while being folded, and holes are formed at a middle and an outer end thereof and fastened to the fin using threads.

An inner end of the rib coming into contact with the main body has a right angle surface to prevent the rib from being bent rearward when deployed.

Advantageous Effects

Thus, according to the present invention, since the swimming assistance mechanism may be easily worn on the arm and continuously propelled by the folding operation of the wing, even the inexperienced swimmer can be assisted to swim easily, and the adaptability to swimming can be increased.

In particular, the wing spreads out only when the arm is stroked for propulsion to provide the resistance to the water current, and the wing is folded and does not protrude from the main body when the stroke is not performed, thereby reducing the reluctance upon wearing, so that the discomfort can be prevented during swimming in the water while the swimming assistance mechanism is worn.

BEST MODE

Mode for Invention

Hereinafter, exemplary embodiments of the present invention will be described in detail with reference to the accompanying drawings.

Figure 1:
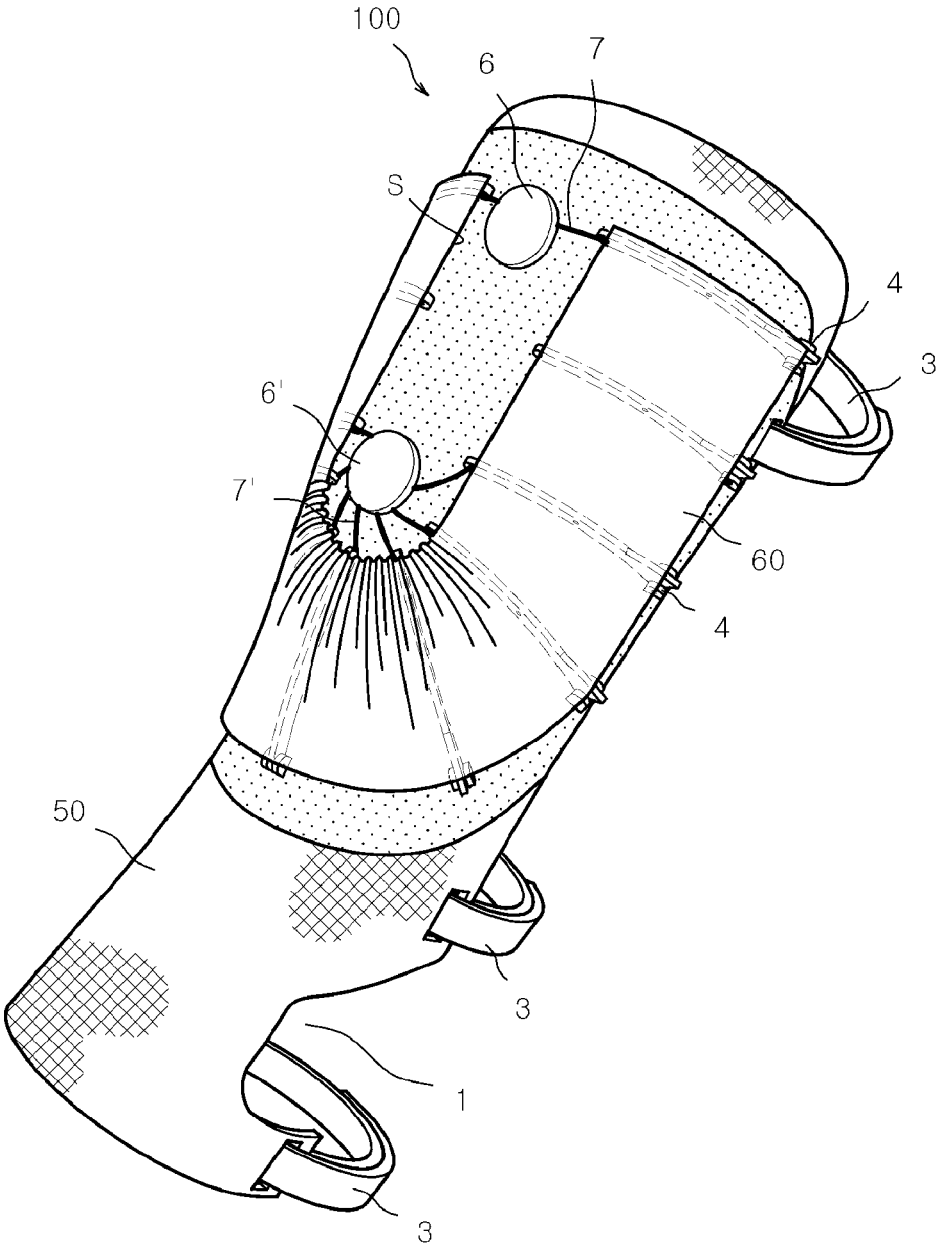
FIG. 1 is an exemplary perspective view of the present invention.
Figure 2:
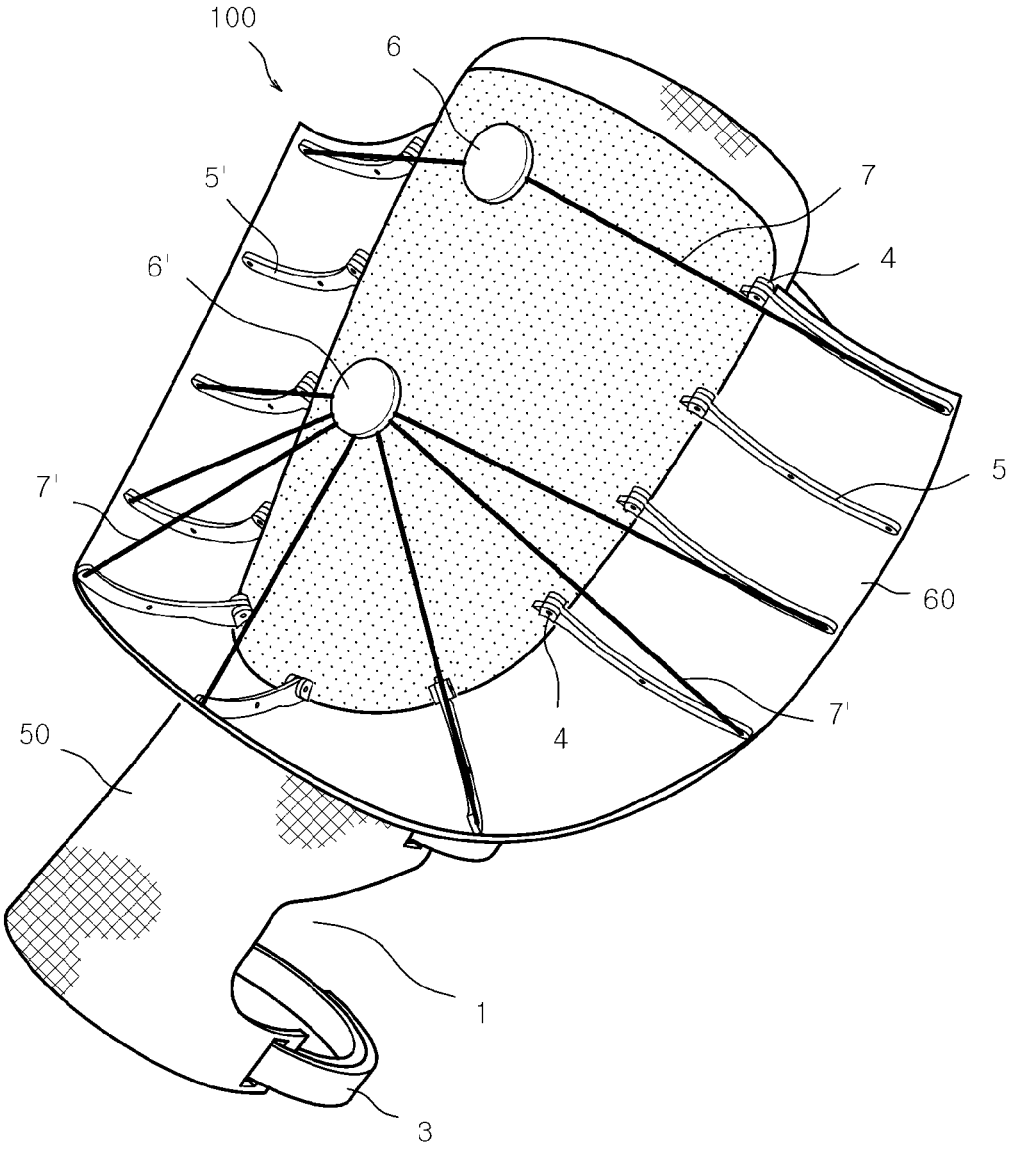
FIG. 2 is an exemplary view showing a fin that is unfolded according to the present invention.

Referring to FIGS. 1 to 2, the swimming assistance mechanism 100 of the present invention includes a main body 50 fixed between the palm and the elbow; and a fin 60 foldably installed on an outer surface of the main body 50.

The main body 50 is formed of a soft synthetic resin material having a strength, is formed at one side thereof with an opening 1 having a length fitted between a palm and an elbow and opened at intervals in a longitudinal direction, and has a shape coming into close contact with the hand and the arm when the arm is inserted through the opening 1, in which a groove 2 for exposing a base of a thumb is formed at a front palm contact part to which a hand is inserted.

In addition, fastening bands 3 for fastening the arm using a Velcro fastener or clip are attached to both end portions and a middle portion of the opening 1 so that the body 50 is fixed and prevented from moving when worn on the arm.

The fin 60 is formed of a durable synthetic fiber, has a U-shape spread outward from the main body 50 except an upper portion on an outer surface of the main body 50 arranged the arm thereon, and is fixed to a plurality of transverse and longitudinal ribs 5 and 5' having hinges 4 on an outer periphery of the main body 50, wherein outer ends of the ribs 5 and 5' are connected to a plurality of wires 7 and 7' wound on a wire winding device 6 and 6' at a center of the main body so as to be folded on the outer surface of the main body 50 by winding force due to wire-winding and unfold while the wires 7 and 7' are pulled and released by a water current overcoming the winding force.

The wire winding device 6 and 6' is mounted therein with a bobbin 9 elastically rotated inside a casing 8 and a leaf spring 10 wound to have a coil shape at an inner side of the bobbin 9, the wires 7 and 7' are sequentially fixed to an outer surface of the bobbin 9 so that the leaf spring 10 is pulled while being wound when the wires 7 and 7' are pulled and, when the pulling force applied to the wires is released, the wires are wound around the bobbin 9 due to returning elastic force of the leaf spring 10, and a number of the wire winding device 6 and 6' is at least one, so that the fin 60 unfold by the water current is folded by winding the wires 7 and 7'.

In addition, the ribs 5 and 5' are formed of synthetic resin or aluminum to have a curved shape so as to come into close contact with a curved surface of the main body 50 when folded about the hinges 4, in which the outer end forms a clearance S when folded to be spaced apart from the main body 50 to allow water to enter while being folded, and holes 11 are formed at a middle and an outer end thereof and fastened to the fin 60 using threads 12, and an inner end of the rib coming into contact with the main body 50 has a right angle surface 13 to prevent the rib from being bent rearward when deployed.

Figure 3:
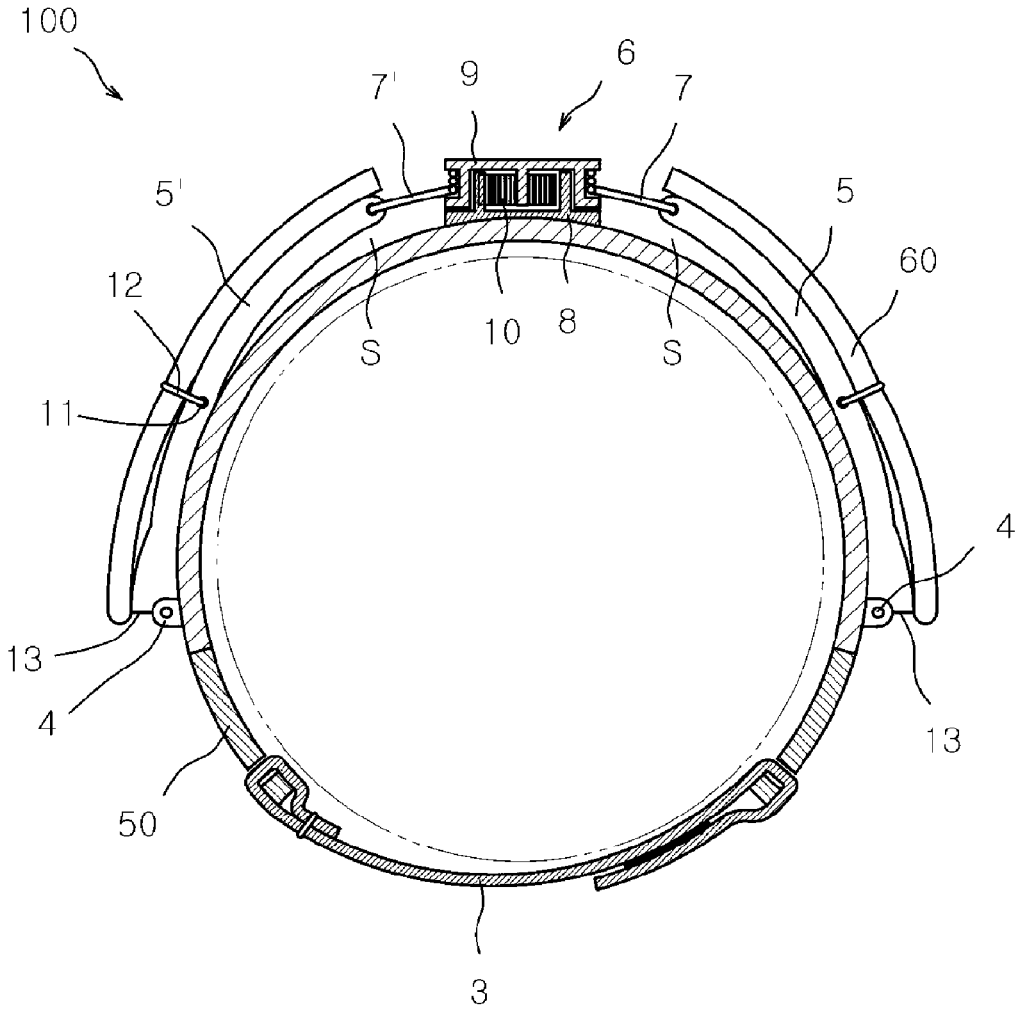
FIG. 3 is a longitudinal sectional view showing the fin that is folded of the present invention.
Figure 4:
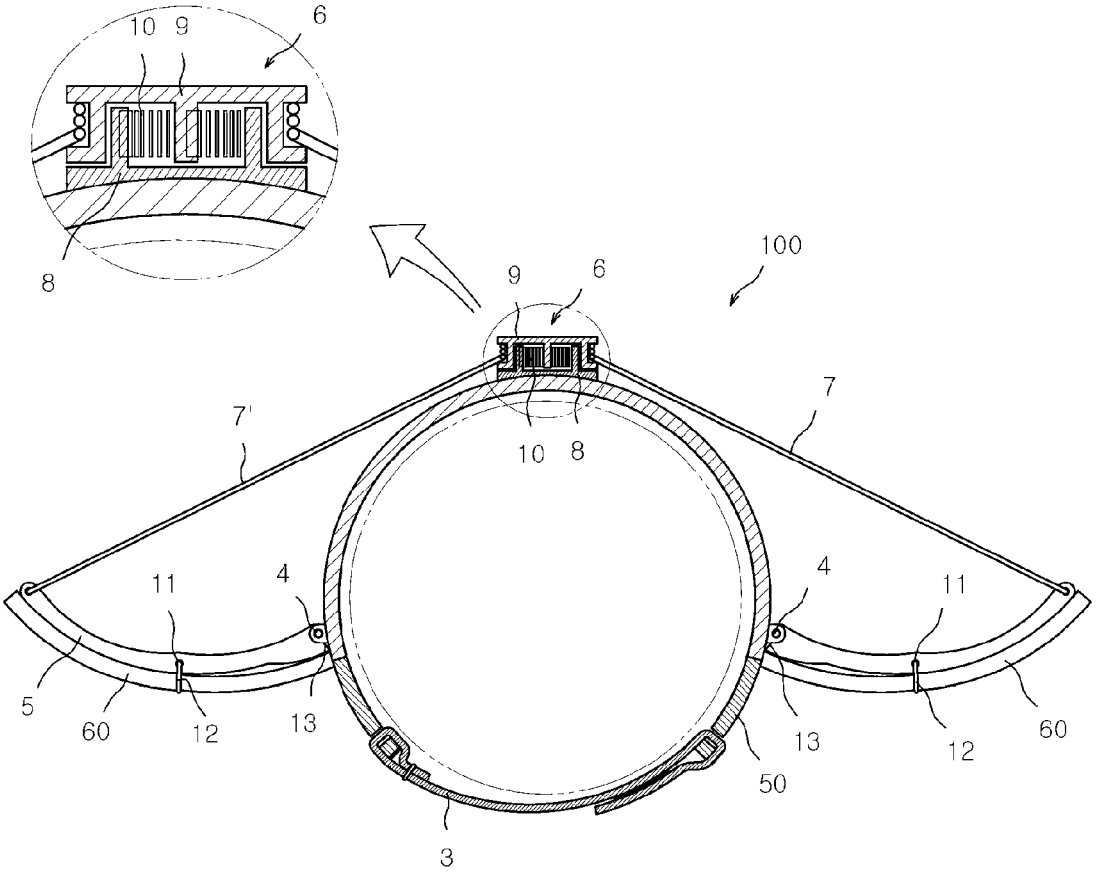
FIG. 4 is a longitudinal sectional view showing the fin that is unfolded of the present invention.

The operational effect of the present invention will be described. the fin 60 installed on the outer surface of the main body 50 remains in close contact with the outer surface of the main body 50 as shown FIGS. 1 and 3, since the wires 7 and 7' connected to the ends of the ribs 5 and 5' reinforcing the fin 60 are wound around the bobbin 9 by the winding force of the leaf spring 10 of the wire winding device 6 and 6' during a usual state.

In the case of swimming in the above state, and when a side of the arm with a little finger is inserted through the opening 1 and the fastening band 3 is firmly fastened to the hand and the arm while the swimming assistance mechanism is worn to expose a base of a thumb on the groove part, the swimming assistance mechanism 100 is integrally combined with the arm. At this point, the both arms may be fastened to the swimming assistance mechanisms 100 to substantially obtain the swimming assistance effect, but the swimming assistance mechanism may be worn on only one arm if necessary.

Figure 5:
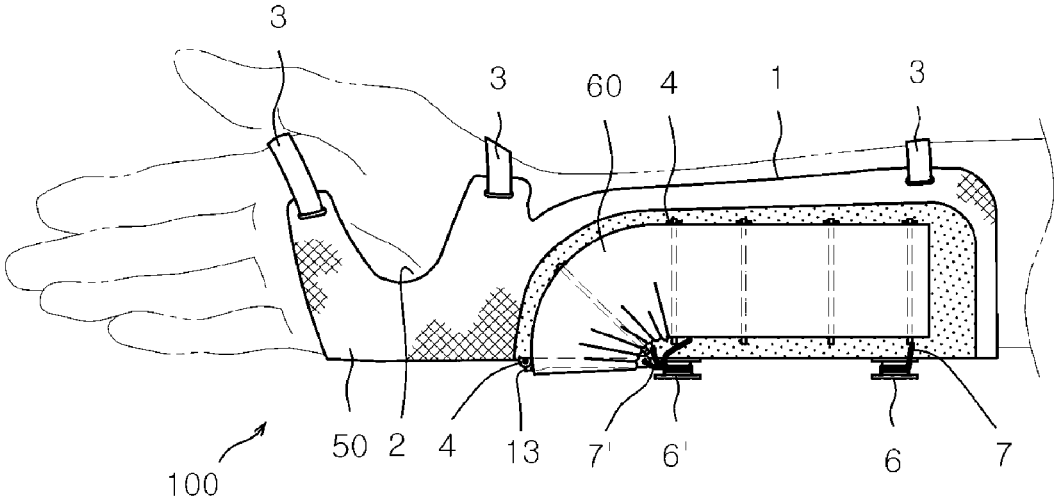
FIG. 5 is a wearing view showing a state in which the fin is folded of the present invention.
Figure 6:
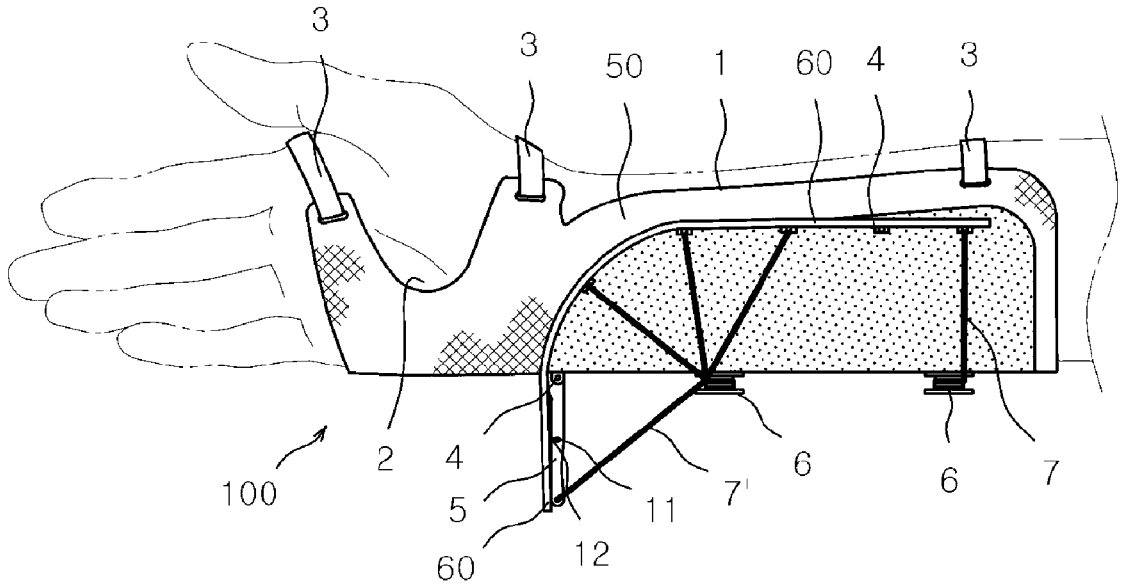
FIG. 6 is a wearing view showing a state in which the fin is unfolded of the present invention.

Accordingly, when the arm is rotated to swim while the swimming assistance mechanism 100 of the present invention is worn, the fin 60 is repeatedly unfolded and folded. For example, when the both arms are moved in front of a head and rotated sideways during breaststroke, the fin 60 is unfolded to both sides of the arm as shown in FIG. 6 from a folded state as shown in FIG. 5 to push water rearward, thereby increasing a propulsion.

More specifically, when the arm is stretched forward while the fins 60 are folded and the arm is rotated sideways, the water is introduced into the clearance S formed between the ribs 5 and 5' reinforcing the fin 60 and the main body 50. Due to the strong water current caused by the force shaking the arm, the fin 60 is unfolded while unwinding the wires 7 and 7' wound by the contraction elasticity of the leaf spring 10 on the wire winding device 6 and 6'. the ribs 5 and 5' are installed in the fin 60 at predetermined intervals, and the sheet formed of synthetic fibers receives resistance from the water and spreads like an umbrella about the hinges 4 as axes so as to alternately protrude in an outward direction of the body 50, so that the fin 60 pushes the water rearward when the arm is shook rearward and the corresponding reaction causes a swimmer to move forward. When the arm moved rearward is rotated forward to repeat the arm stroke, the unfolded fin 60 winds the wires 7 and 7' while the bobbin 9 of the wire winding device 6 and 6' is rotated by the return force of the leaf spring 10, thereby pulling the ribs 5 and 5' connected to the ends of the fin and being folded back to the initial state.

In other words, during swimming, when the arm is pushed from front to back for propulsion while the swimming assistance mechanism 100 is worn on the arm, the fin 60 installed on the outer surface of the main body 50 is unfolded about the hinges 4 of the ribs 5 and 5' by hydraulic pressure and pushes the water while serving as a paddle, so that a strong propulsion may be obtained. In the process of moving from back to front for repeated operation, the fin 60 is pulled and folded by the wires 7 and 7' due to the returning rotational force of the wire winding device 6 and 6', thereby continuously unfolding and folding the fin 60 the arm movements, so that the swimming may be conducted more easily.

The fin 60 is formed in a U-shape that lacks a middle part. Due to the lacking middle part, the water current is introduced into the clearance S through the lacking middle part upon the arm stroke for propulsion, and pushes a portion of the ribs 5 and 5' connected to the wires 7 and 7', that is, the entire inner side of the fin 60, thereby facilitating the deployment. Since the end of the rib 5 and 5' installed to the hinge 4 and coming into contact with the main body 50 when deployed forms a right angle surface 13, the right angle surface 13 prevents the rib from being bent rearward when the fin 60 is deployed.

Particularly, since the fin 60 has the U-shape by the ribs in the longitudinal and transverse directions, the fin is deployed like a U-shape in the longitudinal direction orthogonal to the both transverse directions about the arm when unfolded by the water current as shown in FIG. 6, thereby increasing the resistance of water over a wide range. The fin 60 extending in the transverse and longitudinal directions may serve a role in response to a trajectory of the arm moved horizontally or vertically during swimming. Especially, when the arm is moved from top to bottom, in other words, before the fin in the transverse direction is unfolded, the whole fin is deployed while the fin 60 in the longitudinal direction is unfolded, so that the resistance of the water current is increased according to various movements of the arm, thereby increasing the propulsion.

In addition, it is preferably that all the ribs 5 and 5' to which the fin 60 is attached are connected to the wire winding device 6 and 6' through the wires 7 and 7'. However, as in the embodiment of the accompanying drawing, the unfolding and folding of the fin 60 may not be influenced even when some of the ribs are not connected to the wire winding device 6 and 6' as needed.

Thus, according to the present invention, since the fin 60 may be deployed by the water current while being folded on the outer surface of the main body 50 to serve as a paddle to increase the water resistance, the strong propulsion is generated, so that assist the swimmer to swim easily and well and the adaptability is increased. In addition, the swimming assistance mechanism has a light weight in the worn state and comes integrally close contact with the arm to reduce the reluctance so that the user can easily swim in water.

The invention claimed is:

1. A swimming assistance mechanism comprising:

a main body fixed between a palm and an elbow; and a fin foldably installed on an outer surface of the main body, wherein:

the main body is formed of a synthetic resin material having a strength, and formed at one side thereof with an opening having a length fitted between the palm and the elbow and opened at intervals in a longitudinal direction in which a groove for exposing a base of a thumb is formed at a front palm contact part to which a hand is inserted, and the fin is formed of a synthetic fiber, has a U-shape spread outward from the main body except an upper portion on an outer surface of the main body arranged an arm thereon, and is fixed to a plurality of ribs having hinges on an outer periphery of the main body, in which outer ends of the ribs are connected to a plurality of wires wound on a wire winding device at a center of the main body so as to be folded on the outer surface of the main body by elastic force due to wire-winding and unfold while the wires are pulled and released by a water current overcoming the elastic force.

2. The swimming assistance mechanism of claim 1, wherein fastening bands for fastening the arm using a Velcro fastener or clip are attached to both end portions and a middle portion of the opening so that the main body is fixed and prevented from moving when worn on the arm.

3. The swimming assistance mechanism of claim 1, wherein the main body has a shape coming into contact with the hand and the arm when the arm is inserted through the opening.

4. The swimming assistance mechanism of claim 1, wherein the wire winding device is mounted therein with a bobbin elastically rotated inside a casing and a leaf spring wound to have a coil shape at an inner side of the bobbin, so that the leaf spring is pulled while being wound when the wires are pulled and, when pulling force applied to the wires is released, the wires are wound around the bobbin due to returning elastic force of the leaf spring, and a number of the wire winding device is at least one, so that the fin unfold by the water current is folded by winding the wires.

5. The swimming assistance mechanism of claim 1, wherein the ribs are formed of synthetic resin or aluminum to have a curved shape so as to come into contact with a curved surface of the main body when folded about the hinges, in which the outer end forms a clearance when folded to be spaced apart from the main body to allow water to enter while being folded, and holes are formed at a middle and an outer end thereof and fastened to the fin using threads.

6. The swimming assistance mechanism of claim 1, wherein an inner end of the ribs coming into contact with the main body has a right angle surface to prevent the ribs from being bent rearward when deployed.

7. The swimming assistance mechanism of claim 5, wherein an inner end of the ribs coming into contact with the main body has a right angle surface to prevent the ribs from being bent rearward when deployed.

* * * * *